US008215967B2

(12) United States Patent
Hsieh et al.

(10) Patent No.: US 8,215,967 B2
(45) Date of Patent: Jul. 10, 2012

(54) CONNECTING MEMBER

(75) Inventors: Chung-Cheng Hsieh, Taipei Hsien (TW); Li-Ping Chen, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 18 days.

(21) Appl. No.: 12/882,602

(22) Filed: Sep. 15, 2010

(65) Prior Publication Data

US 2011/0269334 A1 Nov. 3, 2011

(30) Foreign Application Priority Data

Apr. 29, 2010 (CN) ..... 2010 1 0160102

(51) Int. Cl.
*H01R 12/00* (2006.01)

(52) U.S. Cl. ..... 439/67; 174/69

(58) Field of Classification Search ..... 439/67, 439/586, 502; 174/69, 254, 135
See application file for complete search history.

(56) References Cited

U.S. PATENT DOCUMENTS

| | | | | |
|---|---|---|---|---|
| 3,399,909 | A * | 9/1968 | Ambrose | 285/61 |
| 5,341,806 | A * | 8/1994 | Gadsby et al. | 600/393 |
| 5,816,848 | A * | 10/1998 | Zimmerman | 439/502 |
| 6,743,982 | B2 * | 6/2004 | Biegelsen et al. | 174/69 |
| 7,331,817 | B1 * | 2/2008 | Morris et al. | 439/502 |
| 7,488,199 | B2 * | 2/2009 | Gonzalez | 439/502 |
| 7,491,892 | B2 * | 2/2009 | Wagner et al. | 174/254 |
| 8,003,887 | B1 * | 8/2011 | Hsieh et al. | 174/69 |
| 2011/0065319 | A1 * | 3/2011 | Oster et al. | 439/586 |
| 2011/0275240 | A1 * | 11/2011 | Hsieh et al. | 439/502 |
| 2011/0297416 | A1 * | 12/2011 | Hsieh et al. | 174/69 |
| 2011/0306233 | A1 * | 12/2011 | Hsieh et al. | 439/501 |

* cited by examiner

*Primary Examiner* — Renee Luebke
*Assistant Examiner* — Larisa Tsukerman
(74) *Attorney, Agent, or Firm* — Altis Law Group, Inc.

(57) ABSTRACT

A connecting member includes a cable used to transmit signal, a first connector and a second connector connected to the cable, and an elastic member mounted on the cable. The first connector and the second connector are configured for being electronically connected to two electronic components. The elastic member is elastically deformable between a first state, where the elastic member and the cable are constricted, and a second state, where the elastic member and the cable are extended.

8 Claims, 3 Drawing Sheets

CONNECTING MEMBER

CROSS-REFERENCE TO RELATED APPLICATIONS

This application is related to co-pending applications entitled, "CONNECTING MEMBER", filed on Sep. 15, 2010, application Ser. No. 12/882,572, and "CONNECTING MEMBER", filed on Oct. 8, 2010, application Ser. No. 12/900,633.

BACKGROUND

1. Technical Field

The present disclosure relates to a connecting member for connecting two electronic components of an electronic device.

2. Description of Related Art

Generally, a cable is configured for connecting electronic components, such as a hard disk, a motherboard, or an optical disk drive. The cable normally has a surplus portion when connected to the electronic components in order to assure the different distances between each component. The surplus portion of the cable takes up a lot of space, between the electronic components and can be disorderly placed in the electronic device.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
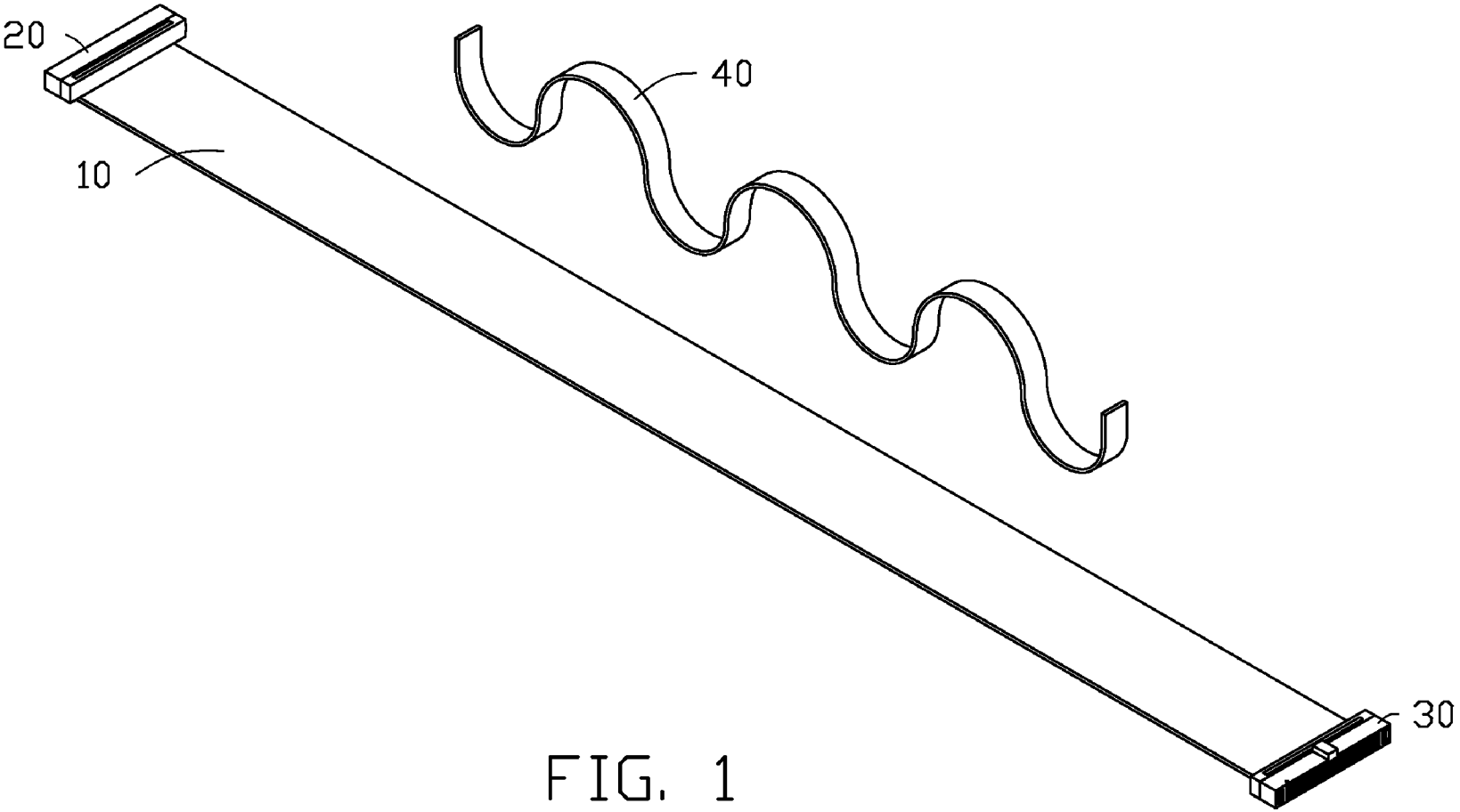
FIG. 1 is an exploded, isometric view of a connecting member in accordance with an embodiment.

Referring to FIG. 1, a connecting member in accordance with an embodiment includes a cable 10, a first connector 20, a second connector 30 and an elastic member 40.

The cable 10 is configured to connect two electronic components (not shown) of an electronic device (not shown) and transfer signals between the two electronic components. In one embodiment, the electronic device can be a computer, or a server. The electronic components can be a storage device, or a motherboard. The cable 10 can be a ribbon cable.

The first connector 20 and the second connector 30 are secured to two ends of the cable 10 and configured to connect two corresponding connectors (not shown) of the electronic components.

Figure 2:
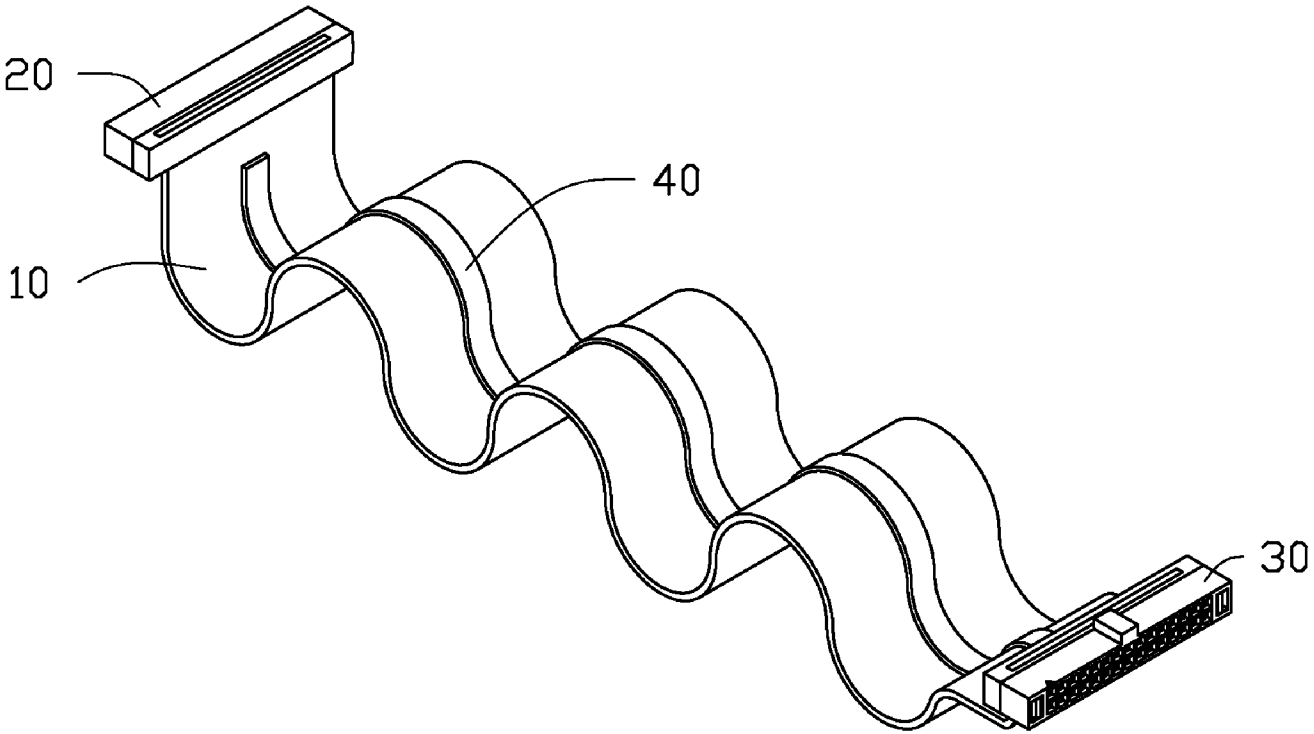
FIG. 2 is an assembled view of FIG. 1, showing the connecting member in a first state.
Figure 3:
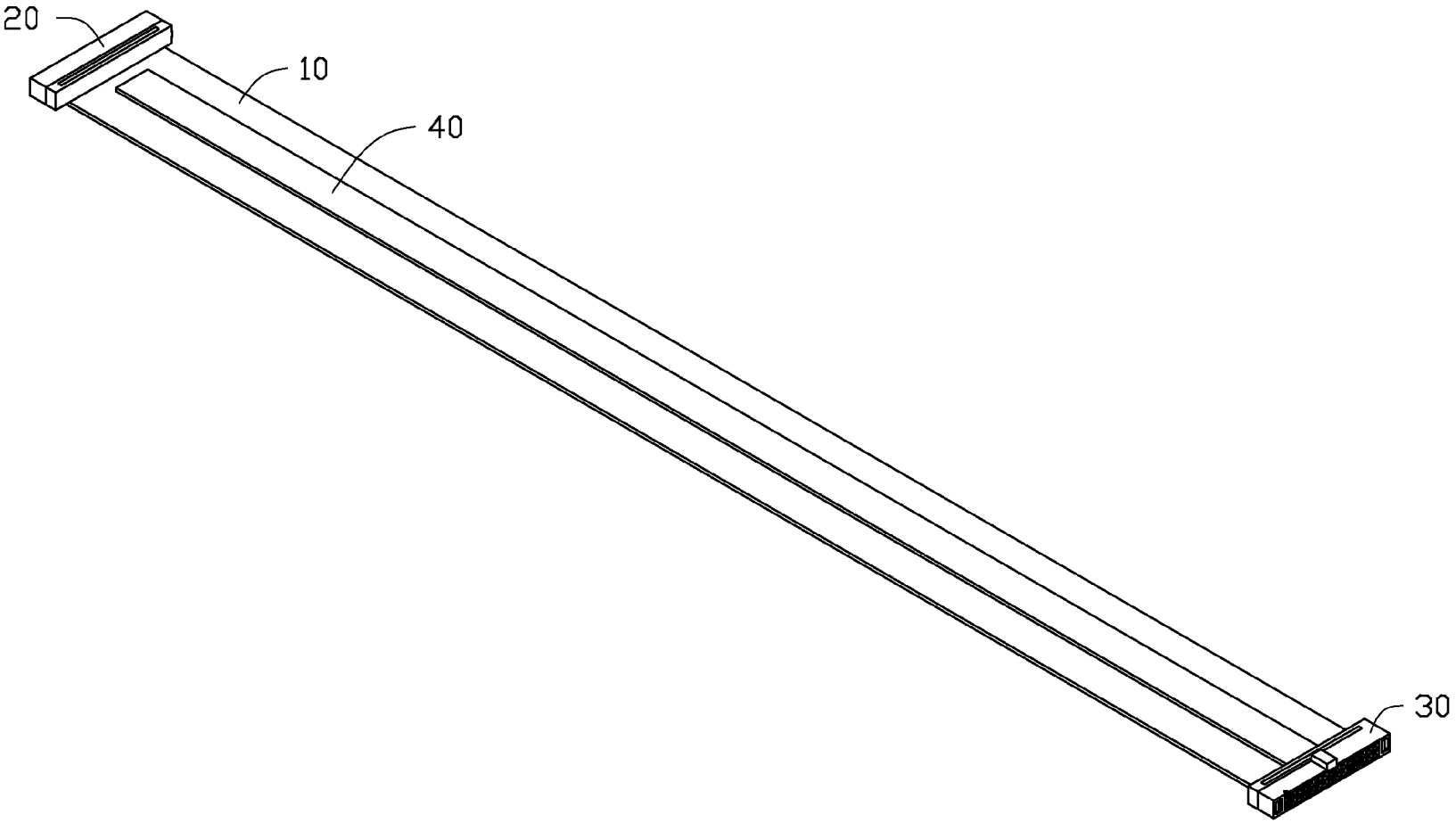
FIG. 3 is similar to FIG. 2, but showing the connecting member in a second state.

Referring to FIGS. 2 and 3, the elastic member 40 may be secured to the cable 10 by adhesives, by screws, or by rivets. The elastic member 40 is elastically deformable between a first state and a second state. The first state is the elastic member 40 and the cable 10 are constricted (shown in FIG. 2), and the second state is the elastic member 40 and the cable 10 are extended together. In one embodiment, in the second state, the elastic member 40 is elastically stretched when the cable 10 is straightened, and a distance between the first and second connector 20, 30 is longer than a distance between the first and second connector 20 and 30 in the first state.

In one embodiment, the elastic member 40 is wave-shaped when constricted. The elastic member 40 is located approximately in the center of the cable 10, and extends from one end near the first connector 20 to another end near the second connector 30. In one embodiment, the cable 10 is wave-shaped when the elastic member 40 is constricted, and the width of the cable 10 is greater than that of the elastic member 40.

In use, the first connector 20 on the cable 10 is connected to an electronic component in a electronic device enclosure, such as a motherboard, and the second connector 30 is connected to another electronic component, such as a storage device. In order to conduct a test, the electronic component is removed from the electronic device enclosure. At this time, the first connector 20 typically is moved away from the second connector 30, so the cable 10 is stretched, and the elastic member 40 is elastically deformed. When the electronic component is placed back in the electronic device enclosure, the elastic member 40 rebounds, to drive the cable 10 to the first state.

In addition, the cable 10 is capable of stretching and constricting with the elastic member 40 that is mounted on the cable 10, therefore, the cable 10 is not easily damaged when the first and second connectors 20 and 30 are connected to the electronic components. The cable 10 is placed between the electronic components in the electronic device enclosure, and the cable's 10 position will not influence the air flow in the electronic device enclosure.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A connecting member comprising:

a cable;

a first connector connected to the cable, configured to be electronically connected to one electronic component;

a second connector connected to the cable, configured to be connected to another electronic component; and an elastic member contacting the cable and located between the first and second connectors; wherein the elastic member is elastically deformable between a first state, where the elastic member and the cable are curved, and a second state, where the elastic member and the cable are substantially straight;

wherein the elastic member comprises an elastic piece, and the elastic piece is wave-shaped when in the first state.

2. A connecting member comprising:

a cable configured to be electronically connected to two electronic components, and an elastic member secured to the cable, and the elastic member being naturally wave-shaped, wherein the elastic member biases the cable toward a first state, wherein in the first state, the cable is constricted.

3. The connecting member of claim 2, further comprising a first connector and a second connector, the first connector is connected to one end of the cable, and the second connector is connected to another end of the cable.

4. The connecting member of claim 2, wherein the elastic member is secured on the cable by adhesives.

5. The connecting member of claim 2, wherein the width of the cable is greater than the width of the elastic member.

6. The connecting member of claim 2, wherein the elastic member is located on a center line of the cable.

7. The connecting member of claim 2, wherein the elastic member is an elastic piece.

8. A connecting member comprising:

a cable configured to be electronically connected to two electronic components, and an elastic member being naturally curved, the elastic member attached to the cable and biasing the cable to a same curved configuration as the elastic member;

wherein the elastic member is wave-shaped.

* * * * *